US011965137B2

(12) United States Patent
Kiiski et al.

(10) Patent No.: US 11,965,137 B2
(45) Date of Patent: Apr. 23, 2024

(54) GASOLINE COMPOSITION WITH OCTANE SYNERGY

(71) Applicant: Neste Oyj, Espoo (FI)

(72) Inventors: Ulla Kiiski, Porvoo (FI); Anna Karvo, Porvoo (FI); Terhi Kolehmainen, Porvoo (FI)

(73) Assignee: NESTE OYJ, Espoo (FI)

( * ) Notice: Subject to any disclaimer, the term of this patent is extended or adjusted under 35 U.S.C. 154(b) by 73 days.

(21) Appl. No.: 17/775,368

(22) PCT Filed: Nov. 13, 2020

(86) PCT No.: PCT/EP2020/082046
§ 371 (c)(1),
(2) Date: May 9, 2022

(87) PCT Pub. No.: WO2021/099220
PCT Pub. Date: May 27, 2021

(65) Prior Publication Data

US 2022/0396744 A1 Dec. 15, 2022

(30) Foreign Application Priority Data

Nov. 21, 2019 (FI) ..... 20196000

(51) Int. Cl.
*C10L 1/02* (2006.01)
*C10L 1/18* (2006.01)
*C10L 1/182* (2006.01)
*C10L 10/10* (2006.01)

(52) U.S. Cl.
CPC ..... *C10L 1/023* (2013.01); *C10L 1/1824* (2013.01); *C10L 10/10* (2013.01); *C10L 2200/0469* (2013.01); *C10L 2270/023* (2013.01)

(58) Field of Classification Search
CPC ..... C10L 1/023; C10L 1/1824; C10L 10/10; C10L 2200/0469; C10L 2270/023; C10L 1/02; C10L 2200/0423
See application file for complete search history.

(56) References Cited

U.S. PATENT DOCUMENTS 4,806,129 A 2/1989 Dorn et al.
7,981,170 B1 * 7/2011 Lieder ..... C10L 1/023 44/451
10,975,319 B2 * 4/2021 Price ..... C10L 1/023
2001/0034966 A1 * 11/2001 Golubkov ..... C10L 10/02 44/437
2005/0279018 A1 12/2005 Cracknell
2006/0162243 A1 7/2006 Wolf
2011/0041792 A1 * 2/2011 Felix-Moore ..... C10L 10/10 44/401
2012/0266838 A1 * 10/2012 Gosselink ..... C10L 1/023 585/16
2013/0199481 A1 8/2013 Rantanen-kolehmainen et al.
2015/0144087 A1 5/2015 Rantanen-kolehmainen et al.
2017/0044443 A1 2/2017 Blommel et al.
2017/0321136 A1 * 11/2017 Orlebar ..... C10L 1/1616
2018/0346837 A1 * 12/2018 Abdul-Manan ..... C10L 1/06
2018/0355265 A1 12/2018 Price et al.
2022/0306960 A1 * 9/2022 Hansch ..... C10L 1/2364

FOREIGN PATENT DOCUMENTS

CN 102559298 A 7/2012
EP 2568033 A2 3/2013
EP 2982734 A1 2/2016
FI 11374 U1 9/2016
WO 2018069137 A1 4/2018

OTHER PUBLICATIONS

Aakko-Saksa et al., "Biogasoline Options—Possibilities for Achieving High Bio-share and Compatibility with Conventional Cars", SAE International, Sep. 11, 2011, vol. 2011-24-0111, 20 pages.
Finnish Search Report issued in corresponding U.S. Appl. No. 20/196,000 dated Mar. 12, 2020.
IEA Technology Collaboration Programme on "IEA-Advanced Motor Fuels Annual Report" 2018, 142 pages.
International Preliminary Report on Patentability (PCT/IPEA/409) dated Jan. 18, 2022, by the European Patent Office for International Application No. PCT/EP2020/082046.
International Search Report (PCT/ISA/210) and Written Opinion (PCT/ISA/237) dated Feb. 17, 2021, by the European Patent Office as the International Searching Authority for International Application No. PCT/EP2020/082046.
Office Action (First Notice of Review Observations) dated Oct. 7, 2023, by the Chinese Patent Office in corresponding Chinese Patent Application No. 202080069295.1, and an English Translation of the Office Action. (12 pages).

* cited by examiner

*Primary Examiner* — Ellen M McAvoy
(74) *Attorney, Agent, or Firm* — BUCHANAN INGERSOLL & ROONEY PC

(57) ABSTRACT

The present invention relates to the field of gasoline and gasoline compositions or blends. More specifically the invention relates to a novel fuel or gasoline composition with synergistic effects and use thereof, and in particular a synergistic effect with respect to the octane rating/octane number.

17 Claims, No Drawings

GASOLINE COMPOSITION WITH OCTANE SYNERGY

TECHNICAL FIELD

The present invention relates to the field of transportation fuels, especially gasoline and gasoline compositions or blends. More specifically the invention relates to a novel fuel or gasoline composition with synergistic effects and use thereof, and in particular a synergistic effect with respect to the octane rating/octane number.

BACKGROUND

Countries around the world have set more and more ambitious targets regarding the bio content of traffic fuels for the future. Currently ethanol is the most commonly used bio component in gasoline. However, ethanol cannot provide the solution to the higher bio content of gasoline as there are maximum limits set for blending ethanol into gasoline. For example, the gasoline standard EN228:2012 sets limits for two different gasoline grades. These grades are classified according to their oxygen content. The first grade may contain a maximum of 3.7 wt-% of oxygen and the second a maximum of 2.7 wt-% of oxygen. In addition to the oxygen limit the first grade sets a maximum limit for ethanol concentration which is 10 vol-%. Consequently, there is a market need for novel fuel blends or compositions wherein the bio content is increased while at the same time keeping the oxygen content within the limits of the prescribed fuel quality directive 2009/30/EC and providing acceptable fuel attributes requested by industry and market. For these reasons there is a need to seek and study alternative bio-based components which do not contain oxygen in the amount of ethanol and which could be utilized in gasoline blending.

EP 2 568 033 relates to a fuel composition comprising from 5 to 20 vol.-% paraffinic hydrocarbons originating from biological oils, fats, or derivatives or combinations thereof. Further, the document relates to compositions comprising oxygenates, such as ethanol present in a concentration of about 5 to 15 vol.-%; or iso-butanol present in a concentration of 5 to 20 vol.-%, preferably about 10 to 17 vol.-%; or ETBE present in a concentration of 7 to 25 vol.-%, preferably about 15 to 22 vol.-%. The bioenergy content of the composition is at least 14 Energy equivalent percentage (E eqv-%) calculated based on the heating values given in the European Renewable Energy Directive 2009/28/EC. The document aims at providing fuels with a high bioenergy content which may be used in conventional gasoline-fueled automotive engines.

WO 2018/069137 relates to a process for making alkylate gasoline compositions and alkylate gasoline compositions comprising renewable naphtha and iso-octane. In particular processes for making alkylate gasoline compositions and compositions of alkylate gasoline compositions comprising renewable naphtha, iso-octane and iso-pentane are described in the document. Such compositions allow a higher mixing ratio of the renewable naphtha and/or a higher Research Octane Number (RON), Motor Octane Number (MON) and vapour pressure compared to not adding a combination of iso-octane and iso-pentane.

CN102559298 relates to clean motor gasoline. The motor gasoline is prepared from the following raw materials in percentage by weight: 2 to 50 percent of methyl acetate, 30 to 95 percent of normal gasoline, 2 to 20 percent of additive A and 1 to 10 percent of additive B, wherein the additive A is one or a combination of more than two of naphtha, petroleum ether and solvent oil; and the additive B is one or a combination of more than two of methyl tert-butyl ether, methylal, cyclopentadiene manganese tricarbonyl, methyl cyclopentadiene manganese tricarbonyl, iso-heptyl ester, tert-butyl ethyl ether, isopropanol, C7 aromatic hydrocarbon, C8 aromatic hydrocarbon and C9 aromatic hydrocarbon. The inventors claim that the gasoline meets various indicators of the fuel, and the fuel has the characteristics of high octane number, high cleanness, low energy consumption and strong power.

U.S. Pat. No. 4,806,129 relates to an efficient and cost competitive fuel extender for mixing with lead-free gasoline used for driving internal combustion engines is provided which makes use of low grade, inexpensive naphtha as its principal ingredient that is upgraded in combination with anhydrous ethanol, toluene, aromatic benzene, xylene and a class of stabilizing and water repellent chemicals, all in a critical range of content. Its synergistic content provides a resultant product that is usable as a compatible additive for lead-free gasoline; low in cost, and does not require any engine adjustments or fuel line protection measures; it may be provided with either a so-called regular or "MID" grade octane rating.

However, none of prior art documents solves the problem of fulfilling e.g. the European automotive fuel standards while maximising the renewable content of a fuel/gasoline blend or composition.

SUMMARY OF THE INVENTION

In contrast, present invention provides a novel fuel/gasoline blend or composition fulfilling the prescribed automotive fuel standard while at the same time maximising the contents of renewable components. Present invention also offers a synergistic effect with respect to measured octane rating.

Consequently, in one aspect, present invention provides for a novel gasoline blend comprising renewable fuel components.

In another aspect, present invention provides for use of the gasoline blend in any fuel composition.

As mentioned herein, present invention relates to a novel fuel composition. In one aspect, the fuel or gasoline composition comprises:

(a) a base gasoline without oxygen content,
(b) a renewable gasoline component,
(c) one or more alcohols.

In another aspect of the invention, the composition comprises:

(a) a base gasoline without oxygen content in an amount in the range from about 60 to about 90 vol % based on the total gasoline composition;
(b) a renewable gasoline component in an amount in the range from 1 to 15 vol % based on the total gasoline composition;

and (c) one or more mono alcohols in an amount in the range from 5 to at the most 15 vol % based on the total gasoline composition, having a RON of about 105 or more; wherein the composition as a whole has a RON of at least 95;

and with the proviso that the components listed in (a), (b), and (c) taken together adds up to 100 vol %.

In one aspect, the composition as a whole comprises an oxygen content of at the most about 3.7 wt %.

In the context of the invention it is to be understood that the term "fuel", "gasoline" or "petrol" may be used interchangeably. The definition also includes the terminology "composition" referring to the total make-up of the blend or mixture of components. Overall, these terms are intended to mean any composition suitable for use in a combustion engine of any kind.

With respect to the term "base gasoline without oxygen content", which is intended to mean any mixture of organic compounds devoid of any oxygen atoms. The term may be abbreviated as "BOB" meaning Blend stock for Oxygenate Blending. The BOB may originate from fossil sources or renewable sources or may be a mixture of these.

In one aspect, BOB may comprise a mixture of small, relatively lightweight hydrocarbons with between 4 and 12 carbon atoms per molecule (commonly referred to as C4-C12). It is a mixture of paraffins (also called alkanes), olefins (also called alkenes) and cycloalkanes (also called naphthenes). The BOB may also further comprise various aromatic compounds.

In another aspect, the base gasoline without oxygen content may be a combination of hydrocarbons comprising paraffins, and aromatic and olefinic hydrocarbons, having from 4 to 9 carbon atoms.

In one aspect, the BOB may be a combination of hydrocarbons comprising paraffins, and aromatic and olefinic hydrocarbons, having from 4 to 9 carbon atoms, wherein the olefinic content may be about 8 to about 30 vol %, e.g. about 12 to about 25 vol %, e.g. about 20 vol % and the aromatic content is about 25 to 50 vol %, e.g. about 30 to about 45 vol %, e.g. about 40 vol %.

The BOB may have a boiling point in the range from e.g. about 30° C. to about 230° C., preferably from about 30° C. to about 210° C.

In one aspect, the BOB originates from non-renewable sources, such as e.g. fossil based material.

With respect to the term "oxygenate", this term is intended to mean any agent or entity that adds to the total oxygen content of the finished composition. One non-limiting example is alcohols, which contain at least one oxygen atom and which, when added to a fuel component, adds to the total molecular oxygen content of the composition or blend. Non-limiting examples are e.g. methanol, ethanol, propanol, or iso-propanol. Other examples of oxygenates may be e.g. ethers, such as e.g. tert-butyl methyl ether.

With respect to the term "renewable" in the context of a renewable fuel component, this term refers to one or more organic compounds derived from any renewable source (i.e. not from any fossil based source). Thus, the renewable fuel component is based on renewable sources and consequently does not originate from or is derived from any fossil based material. Such component is characterised by mandatorily having a higher content of $^{14}C$ isotopes than similar components derived from fossil sources. Said higher content of $^{14}C$ isotopes is an inherent feature characterizing the renewable fuel component and distinguishing it from fossil fuels. Thus, in gasoline blends, wherein a portion of the blends is based on partly fossil based material and partly renewable fuel component, the renewable component can be determined by measuring the $^{14}C$ activity. Analysis of $^{14}C$ (also referred to as carbon dating or radiocarbon analysis) is an established approach to determine the age of artefacts based on the rate of decay of the isotope $^{14}C$, as compared to $^{12}C$. This method may be used to determine the physical percentage fraction of renewable materials in bio/fossil mixtures as renewable material is far less aged than fossil material and so the types of material contain very different ratios of $^{14}C$:$^{12}C$. Thus, a particular ratio of said isotopes can be used as a "tag" to identify a renewable carbon compound and differentiate it from non-renewable carbon compounds. While the renewable component reflects the modern atmospheric $^{14}C$ activity, very little $^{14}C$ is present in fossil fuels (oil, coal). Therefore, the renewable fraction of any material of interest is proportional to its $^{14}C$ content. Samples of fuel blends may be analysed post-reaction to determine the amount of renewable-sourced carbon in the fuel. This approach would work equally for co-processed fuels or fuels produced from mixed feedstocks. It is to be noted that there is not necessarily any need to test input materials when using this approach as renewability of the fuel blend may be directly measured. The isotope ratio does not change in the course of chemical reactions. Therefore, the isotope ratio can be used for identifying renewable isomeric paraffin compositions, renewable hydrocarbons, renewable monomers, renewable polymers, and materials and products derived from said polymers, and distinguishing them from non-renewable materials.

Feedstock of raw material of biological origin means material having only renewable (i.e. contemporary or biobased or biogenic) carbon, $^{14}C$, content which may be determined using radiocarbon analysis by the isotopic distribution involving $^{14}C$, $^{13}C$ and/or $^{12}C$ as described in ASTM D6866 (2018). Other examples of a suitable method for analysing the content of carbon from biological or renewable sources are DIN 51637 (2014) or EN 16640 (2017).

For the purpose of the present invention, a carbon-containing material, such as a feedstock or product is considered to be of biological i.e. renewable origin if it contains 90% or more modern carbon (pMC), such as 100% modern carbon, as measured using ASTM D6866.

As used herein, the term "renewable gasoline component" is intended to mean a mixture of C4 to C9 hydrocarbons ($C_nH_{2n+2}$, n=4, 5, 6, 7, 8 or 9), i.e. straight or branched hydrocarbons having 4 to 9 carbon atoms originating from renewable sources such as e.g. plant oil or animal fat and consequently not derived from any fossil based material. Such hydrocarbons may be n-alkanes and/or iso-alkanes. Consequently, the renewable gasoline component may comprise a mixture of one or more of n-hexane, n-pentane, 2-methylbutane (iso-pentane) and other C4 to C9 alkanes such as e.g. 2-methyl pentane, 2,3-dimethyl butane, heptane, 3-methyl hexane. The renewable gasoline component may have a boiling point range of e.g. about 40° C. to about 170° C.

As used herein, the term "alcohol" is intended to mean any entity wherein an organic molecule has at least one hydroxyl substituent. The term "mono-alcohol" is intended to mean an organic molecule having one and only one hydroxyl substituent. In one aspect, the alcohol may have the formula of R—OH, wherein "R" denotes any alkyl group and may have 1 to 10 carbon atoms. Non-limiting examples of alcohols are methanol, ethanol, propanol, iso-propanol (2-propanol), butanol, iso-butanol, tert-butanol and the likes. In the context of the invention, alcohols may be regarded as oxygenates, i.e. components that adds to the oxygen content of the composition or blend as a whole.

DETAILED DESCRIPTION OF THE INVENTION

In describing the embodiments of the invention, specific terminology will be resorted to for the sake of clarity. However, the invention is not intended to be limited to the specific terms so selected, and it is understood that each specific term includes all technical equivalents, which operate in a similar manner to accomplish a similar purpose.

When describing the embodiments or aspects of the present invention, the combinations and permutations of all possible embodiments have not been explicitly described. Nevertheless, the mere fact that certain measures are recited in mutually different dependent claims or described in different embodiments does not indicate that a combination of these measures cannot be used to advantage. The present invention envisages all possible combinations and permutations of the described embodiments.

The terms "comprising", "comprise" and "comprises" herein are intended by the inventors to be optionally substitutable with the terms "consisting of", "consist of" and "consists of", respectively, in every instance.

The invention in one aspect relates to a novel fuel composition.

Thus, present invention relates to a fuel or gasoline composition which comprises:

(a) a base gasoline without oxygen content, (b) a renewable gasoline component, (c) one or more alcohols.

The prepared composition may be used as is, without further elaboration or modification, or may be further used in blending or preparing other compositions.

In one aspect, the base gasoline without oxygen content may be in an amount in the range from e.g. about 20 vol % to about 95 vol %, such as e.g. about 30 vol % to about 95 vol %, such as e.g. about 40 vol % to about 95 vol %, such as e.g. about 50 vol % to about 95 vol %, such as e.g. about 60 vol % to about 95 vol %, such as e.g. about 70 vol % to about 95 vol %, such as e.g. about 80 vol % to about 95 vol %, or such as e.g. about 60 vol % to about 90 vol %.

In one aspect, the base gasoline without oxygen content may be in an amount in the range from e.g. about 60 vol % to about 90 vol % based on the total gasoline composition.

The base gasoline without oxygen content may be a combination of hydrocarbons comprising paraffins, aromatic compounds and olefinic hydrocarbons having about 4 carbon atoms or more, such as 4 to 12 carbon atoms. An example of a BOB comprises a mixture of n-paraffins, iso-paraffins, aromatics, naphthenes, and olefins. The amount of paraffins (n-paraffins, i-paraffins and cycloparaffins) may be in the range of about 10 to about 65 vol %, the olefinic content may be about 8 to about 30 vol %, e.g. about 12 to about 25 vol %, e.g. about 20 vol % and the aromatic content is about 25 to 50 vol %, e.g. about 30 to about 45 vol %, e.g. about 40 vol %, of the total content of the BOB. It is understood that the listed components add up to a total of 100 vol % of the BOB. As implied by the definition, no compounds are present which comprise any oxygen atoms in the BOB. In one aspect, benzene may be present in an amount of less than or equal to about 1 vol %.

In one aspect, the base gasoline without oxygen may be a combination of hydrocarbons comprising paraffins, aromatic compounds and olefinic hydrocarbons having preferably from 4 to 9 carbon atoms in an amount of which may be present in an amount of 50 vol % or more, such as e.g. about 60 vol-% or more, preferably 70 vol-% or more, more preferable 80 vol-% or more, and most preferred 85 vol-% or more. In one aspect, the amount is less than about 90 vol %.

The base gasoline without oxygen may have a boiling point in the range from about 30° C. to about 230° C., or preferably from about 30° C. to about 210° C.

With respect to the renewable gasoline component, this component may in principle be any type of gasoline which is derived from renewable sources. Such sources may be in principle be any type of material as long as such material is not derived from fossil-based material. Suitable material may be any plant based or animal based material. The renewable sources may comprise vegetable oil, wood oil, other plant based oil, animal oil, animal fat, fish fat, fish oil, algae oil, microbial oil, or a combination thereof. Optionally or additionally, the renewable feedstock may comprise recyclable waste and/or recyclable residue. Recyclable waste comprises material such as used cooking oil, free fatty acids, palm oil, by-products or process side streams, sludge, and side streams from vegetable oil processing.

In one aspect, the renewable gasoline component may be present in an amount of about 1 vol % to about 15 vol %, such as e.g. 3 vol % to about 10 vol %, such as e.g. about 5 vol % to about 10 vol %, such as e.g. about 6 vol % to about 10 vol %, or about 3 vol %, about 4 vol %, about 5 vol %, about 6 vol %, about 7 vol %, about 8 vol %, about 9 vol %, about 10 vol % based on the total gasoline composition.

In another aspect, the renewable gasoline component may be present in an amount of about 6 vol % of the total gasoline composition.

As meant herein, the "total" gasoline composition is meant the finished composition, wherein all components mentioned herein and in the claims have been mixed together. Usually, the terminology entails the vol % (volume percentage; V/V) but may also be w % (weight percentage; m/m) as appropriate and as indicated in each instance.

According to the invention, the renewable gasoline component may comprise essentially a mixture of C4-C9 hydrocarbons (i.e. hydrocarbons having 4 to 9 carbon atoms), such as a mixture of C4-C9 n-alkanes and iso-alkanes. Put differently, the renewable gasoline component may comprise a mixture of C4 to C9 hydrocarbons ($C_nH_{2n+2}$, n=4, 5, 6, 7, 8 or 9), i.e. straight or branched hydrocarbons having 4 to 9 carbon atoms originating from renewable sources such as e.g. plant or animal material and consequently not derived from any fossil based material. Non-limiting examples of relevant hydrocarbons may be n-alkanes and/or iso-alkanes. Consequently, the renewable gasoline component may comprise a mixture of one or more of n-hexane, n-pentane, 2-methylbutane (iso-pentane) and other C4 to C9 alkanes such as e.g. 2-methyl pentane, 2,3-dimethyl butane, heptane, 3-methyl hexane.

The renewable gasoline component may be very low in aromatic contents, i.e. contain a low amount of aromatic compounds such as e.g. benzene and/or toluene. Thus, the aromatic content may be e.g. about 0.1 vol %, preferably less than 0.1 vol % or even aromate-free.

The renewable gasoline component may have a boiling point range of e.g. about 40° C. to about 170° C.

In one aspect, the alcohol may be a mono-alcohol which is an organic molecule having one hydroxyl substituent.

In a further aspect of the invention, the alcohol may have the formula of R—OH, wherein "R" denotes any alkyl group, which may be straight or branched, and may have 1 to 10 carbon atoms. The alcohol can be either bio-based or fossil-based. Non-limiting examples of alcohols are methanol, ethanol, propanol, iso-propanol (2-propanol), butanol, iso-butanol, tert-butanol and the likes.

A preferred alcohol is iso-propanol (2-propanol).

In the context of the invention, alcohols may be regarded as oxygenates, i.e. components that adds to the oxygen content of the composition or blend as a whole.

The alcohol may be present in an amount of e.g. about 5 vol % to about 14 vol % based on the total gasoline composition, such as e.g. about 10 vol % to about 14 vol % based, such as e.g. about 5 vol %, about 10 vol %, about 12 vol %, or about 14 vol % of the total composition.

In a preferred embodiment, the alcohol content may be present in an amount of about 12 vol % or about 14 vol % of the total composition.

In yet a further preferred embodiment, the alcohol content is about 14 vol % of the total composition.

In a further aspect of the invention, the gasoline composition may comprise a mixture of several different alcohols.

According to the invention, the gasoline composition may have a RON (research octane number) which may be e.g. at least about 95 or higher, such as e.g. at least about 98 or higher.

In one aspect, the gasoline composition according to the invention may have a RON of about 98 or higher.

According to the invention, the gasoline composition may have a MON (motor octane number) which may be e.g. at least about 85 or higher.

In one aspect, the invention relates to a composition that comprises:

(a) a base gasoline without oxygen content in an amount in the range from about 60 to about 90 vol % based on the total gasoline composition;

(b) a renewable gasoline component in an amount in the range from 1 to 15 vol % based on the total gasoline composition;

and (c) one or more mono alcohols in an amount in the range from 5 to at the most 15 vol % based on the total gasoline composition, having a RON of about 105 or more; wherein the composition as a whole has a RON of at least 95;

and with the proviso that the components listed in (a), (b), and (c) taken together adds up to 100 vol %.

In one aspect, the composition as a whole comprises an oxygen content of at the most about 3.7 wt %.

The inventors of present invention have surprisingly found that by employing an addition of isopropanol, an unexpected increase in terms of MON and RON is observed in combination with employing a renewable source of fuel in a fuel blend, thus offering a novel fuel blend with desired properties required according to fuel standards.

EXAMPLES

Example 1

Three different blends with oxygen content of 3.7 wt-% were prepared and mixed

IPA1: 86 vol % 95 octane gasoline without oxygen (BOB)+14 vol % isopropanol (IPA)

IPA2: 80 vol % BOB+14 vol % IPA+6 vol % renewable gasoline component

IPA3: 76 vol % BOB+14 vol % IPA+10 vol % renewable gasoline component.

With respect to the above mentioned compositions, the following properties were analysed:

RON and MON

Density

Distillation

Vapour pressure

Hydrocarbon composition (EN ISO22854)

The above analysis resulted in the figures seen in Table 1 below:

| | Method | BOB | IPA 1 (calculated) | IPA 1 (analysed) | IPA 2 (calculated) | IPA 2 (analysed) | IPA 3 (calculated) | IPA 3 (analysed) |
|---|---|---|---|---|---|---|---|---|
| Density (kg/m3) | EN ISO12185 | 741.9 | 748.2 | 748.1 | 744.6 | 739.6 | | |
| DVPE (kPa) | EN 13016-1 | 65.9 | 67.0 | 66.6 | 65.0 | 63.2 | | |
| Olefins (vol-%) | | 15.8 | 14.0 | 13.5 | 13.0 | 12.1 | | |
| Aromatics (vol-%) | | 34.4 | 30.0 | 30.1 | 28.0 | 26.9 | | |
| RON | EN ISO5164 | 95.1 | 97.6 | 97.7 | 94.5 | 98.0 | 92.5 | 94.7 |
| MON | EN ISO5163 | 84.2 | 86.0 | 85.7 | 83.6 | 85.8 | 82.0 | 84.8 |

The blends were calculated based on the volume or mass fractions of each component and assuming linear behaviour. Adding mono-alcohol with high octane numbers was expected to boost the octane numbers compared to the base gasoline without oxygen. Surprisingly, this phenomena was further enhanced by the addition of renewable gasoline component bringing synergistic blending benefits.

For reference and comparison reasons various physical properties are seen in Table 2 below:

| Property | Ethanol | Isopropanol | Renewable gasoline component |
|---|---|---|---|
| Density (g/cm3) | 0.789 | 0.785 | 0.683 |
| Vapour pressure (kPa) | 19 | 15 | 40 |
| Oxygen content (wt-%) | 34.7 | 26.6 | 0 |
| RON | 109 | 113 | >60 |
| MON | 90 | 97 | <60 |

The invention claimed is:

1. A gasoline composition comprising:

(a) a base gasoline without oxygen, representing a component in an amount ranging from 61 vol % to 87 vol % of a total gasoline composition;

(b) a renewable gasoline component in an amount ranging from 1 vol % to 15 vol % of the total gasoline composition; and (c) iso-propanol in an amount ranging from 12 vol % to 14 vol % of the total gasoline composition, wherein the iso-propanol has an octane rating number (RON) of about 105 or more; and wherein the gasoline composition as a whole has a RON of at least 95; and wherein the components listed in (a), (b), and (c) taken together add up to 100 vol %.

2. The gasoline composition according to claim 1, wherein the gasoline composition as a whole comprises:

an oxygen content of at most about 3.7 wt %.

3. The gasoline composition according to claim 1, wherein the gasoline composition as a whole has a RON of about 98 or higher.

4. The gasoline composition according to claim 1, wherein the base gasoline without oxygen in (a) is a combination of hydrocarbons comprising:

paraffins, aromatic compounds and olefinic hydrocarbons having 4 carbon atoms or more.

5. The gasoline composition according to claim 1, wherein the base gasoline without oxygen in (a) is a combination of hydrocarbons comprising:

paraffins, aromatic compounds and olefinic hydrocarbons having from 4 to 9 carbon atoms in an amount which is 50 vol % or more of the total gasoline composition.

6. The gasoline composition according to claim 1, wherein the base gasoline without oxygen in (a) has a boiling point ranging from about 30° C. to about 230° C.

7. The gasoline composition according to claim 1, wherein the renewable gasoline component in (b) is present in an amount of about 3 vol % to about 10 vol %, based on the total gasoline composition.

8. The gasoline composition according to claim 1, wherein the renewable gasoline component in (b) is present in an amount of about 6 vol % based on the total gasoline composition.

9. The gasoline composition according to claim 1, wherein the renewable gasoline component in (b) comprises essentially:

a mixture of C4-C9 hydrocarbons.

10. The gasoline composition according to claim 1, wherein the renewable gasoline component in (b) has a boiling point ranging from about 40° C. to about 170° C. at normal pressure.

11. The gasoline composition according to claim 1, wherein the RON is at least about 85.

12. The gasoline composition according to claim 1, wherein a dry vapor pressure equivalent (DVPE) of the gasoline composition ranges from about 45.0 kPa to about 100 kPa.

13. The gasoline composition according to claim 1, wherein said iso-propanol in (c) is bio-based and/or fossil-based.

14. The gasoline composition according to claim 1, wherein a dry vapor pressure equivalent (DVPE) of the gasoline composition is about 65 kPa.

15. The gasoline composition according to claim 1, wherein the renewable gasoline component in (b) comprises essentially:

a mixture of C4-C9 n-alkanes and isoalkanes.

16. The gasoline composition according to claim 1, wherein the base gasoline without oxygen in (a) is a combination of hydrocarbons comprising:

paraffins, aromatic compounds and olefinic hydrocarbons having 4 to 12 carbon atoms.

17. The gasoline composition according to claim 1, wherein the base gasoline without oxygen ranges from 71 vol % to 87 vol % of the total gasoline composition.

* * * * *